United States Patent [19]

Hughes

[11] 4,331,332

[45] May 25, 1982

[54] PORTABLE GOLF PRACTICE STATION

[76] Inventor: Royal W. Hughes, 3675 Gordon Rd., Elkhart, Ind. 46516

[21] Appl. No.: 223,321

[22] Filed: Jan. 8, 1981

[51] Int. Cl.[3] ..... A63B 69/36

[52] U.S. Cl. ..... 273/195 B

[58] Field of Search ..... 273/195 R, 195 A, 195 B, 273/186 R, 196, 197, 198, 176 H, 183 A, 187 R, 187 A, 187 B

[56] References Cited

U.S. PATENT DOCUMENTS

| | | | |
|---|---|---|---|
| 82,647 | 9/1868 | Shepard | 273/195 R |
| 3,107,920 | 10/1963 | Strunk | 273/186 R |
| 3,348,847 | 10/1967 | Fischl | 273/195 R X |
| 3,639,923 | 2/1972 | Stewart | 273/195 B X |
| 4,279,420 | 7/1981 | Bay et al. | 273/195 B X |

FOREIGN PATENT DOCUMENTS

| | | | |
|---|---|---|---|
| 28007 | of 1912 | United Kingdom | 273/195 A |

*Primary Examiner*—George J. Marlo

*Attorney, Agent, or Firm*—Marmaduke A. Hobbs

[57] ABSTRACT

A golf practice station in which a platform has two resilient surfaces, one of the surfaces forming an area for the golfer to stand, the other forming an area in which the tee for the golf ball is placed. The areas preferably consist of flexible resilient perforated mats disposed in recesses and the mats are removable to assist in cleaning the station from time to time. The platform is tiltable forwardly, rearwardly and end-to-end in order to simulate fairway conditions, and the tilting may be done by removable blocks attached to adjacent end or side corners of the platform. The station is portable and can normally be lifted by one man and easily stored when not in use.

5 Claims, 7 Drawing Figures

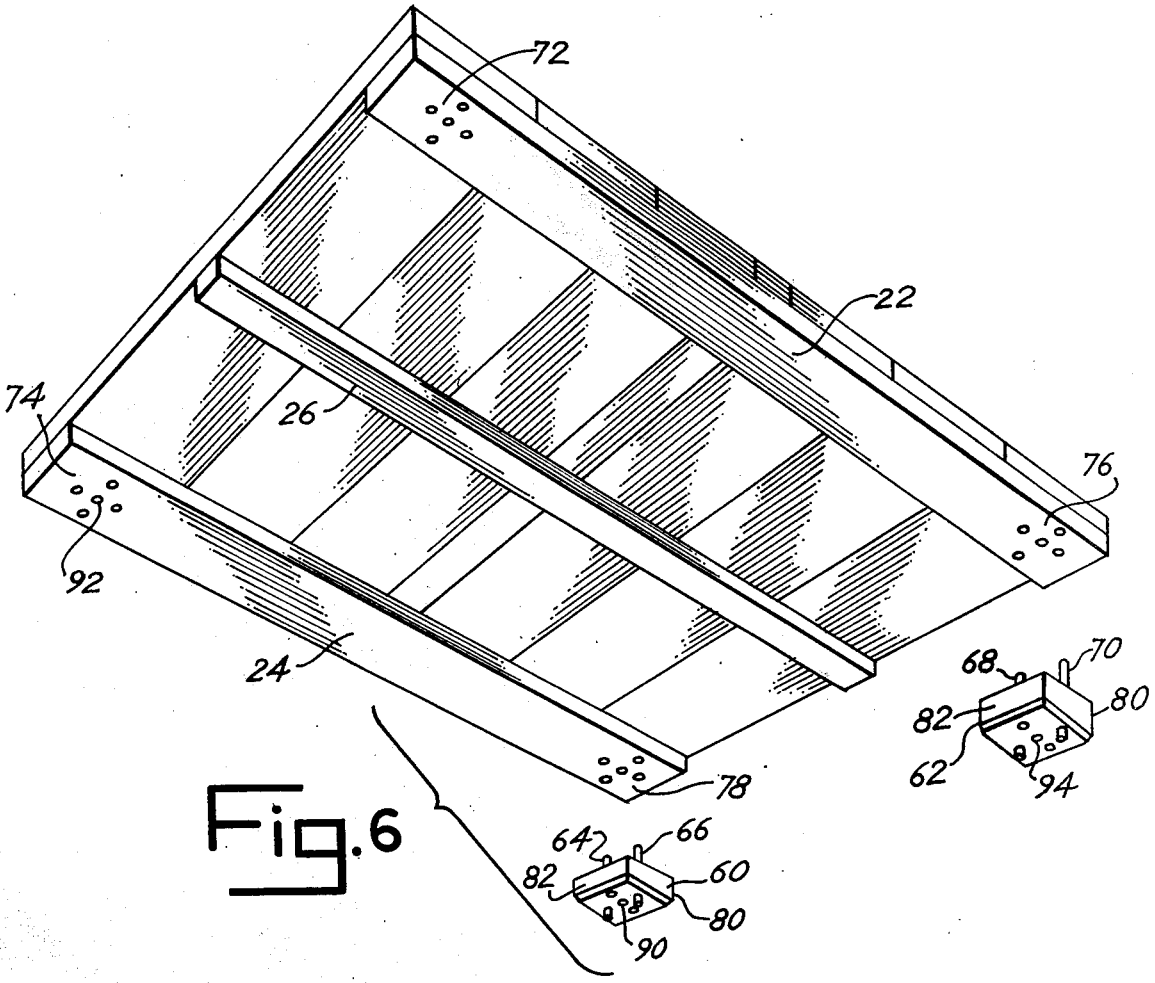
Fig. 6
Fig. 7
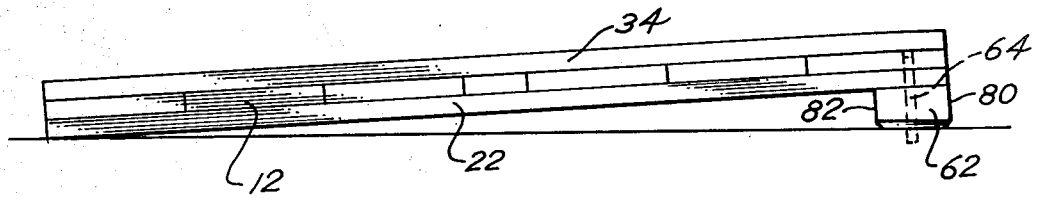

PORTABLE GOLF PRACTICE STATION

BACKGROUND OF THE INVENTION

There are often occasions when a golfer does not have the time when the weather is good to play a round of golf but has the time to practice driving from a golf tee. Public places are provided for practice driving, but those places are often not close to the golfer's home and hence require a substantial amount of time to reach the place and thereafter prepare for practice. As an alternative and for convenience, golf driving nets are installed in the backyard or some other similar place around the golfer's home where he can practice driving in his spare time and with little advance preparation. These home installations for practice driving are satisfactory for practicing tee-offs and simulated drives on the fairway, but they offer little variety in the way of driving from sloping terrain, such as that often encountered on a conventional golf course. Further, the practice tee-off station often becomes excessively used and hence bare of grass and, in times of damp weather, often muddy and unsuitable for practice. In addition, in cold weather the ground may become frozen and possibly ice or snow covered and cannot be used, even if the temperature and atmosphere are such that with proper clothing the golfer could spend some of his idle time practicing a few drives. These adverse conditions have generally prevented the home practice installations from becoming popular or being used to maximum advantage.

SUMMARY OF THE INVENTION

It is one of the principal objects of the present invention to provide a golf practice station which can be adjusted to simulate both flat and sloping terrain of a fairway, and which provides firm and non-skid footing for the golfer regardless of the weather conditions or the nature or condition of the ground on which the station is placed for practice.

Another object of the invention is to provide a golf practice station which is portable and can be used either at a driving range or in a rather confined area with a golf ball net, and which can be readily set in place for practice and easily stored when not in use.

These and other objects are achieved by the present invention which relates to a practice station having a generally flat platform having a place for golf balls to be placed on a tee and a place for the golfer to stand for driving the ball. The platform is stiff and firm and has means for tilting the platform selectively in various directions to simulate the terrain encountered on golf courses. The station can normally be lifted and carried by one man and can be moved from place to place to prevent it from ruining a lawn, and can be easily and conveniently stored and transported. A non-skid mat or surface is preferably used for the place on the station where the golfer stands, and a soft or resilient surface is preferably provided in the area where the golf ball tee is located. Adjustments in the adjustment means can be made from time to time during the practice period in order to vary the driving conditions in a manner simulating actual playing conditions.

BRIEF DESCRIPTION OF THE DRAWINGS

FIG. 6 is a partially exploded, bottom plan view of the golf practice station shown in the preceding figures; and FIG. 7 is a side elevational view of the golf practice station shown in the preceding figures, illustrating one position of the station.

DESCRIPTION OF THE PREFERRED EMBODIMENT

Figure 1:
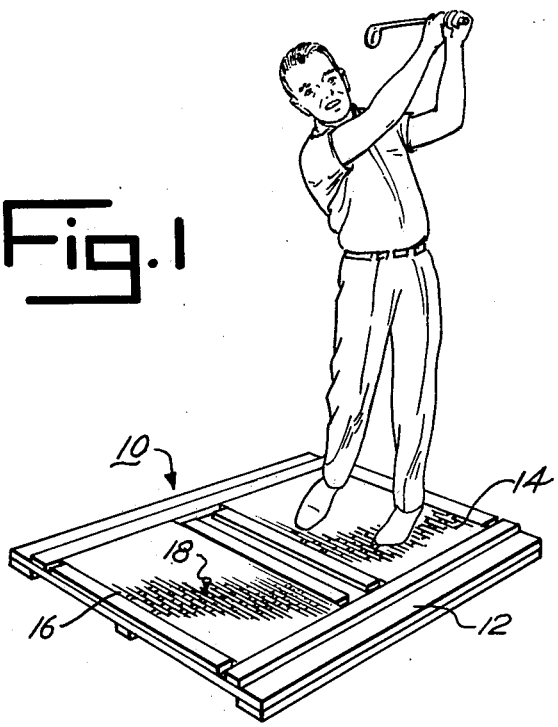
FIG. 1 is a perspective view of the present golf practice station, showing a golfer standing thereon in the position immediately after completing a drive.
Figure 2:
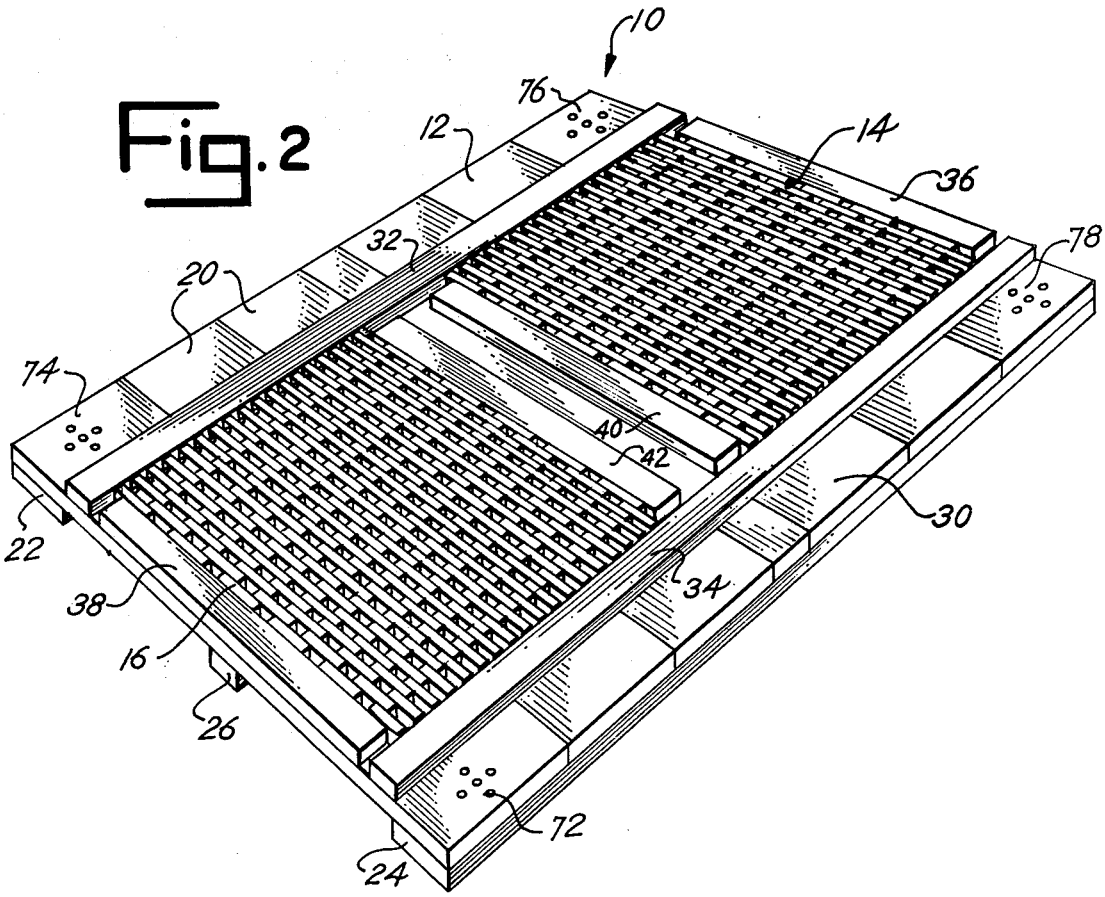
FIG. 2 is an enlarged perspective view of the golf practice station shown in FIG. 1.
Figure 3:
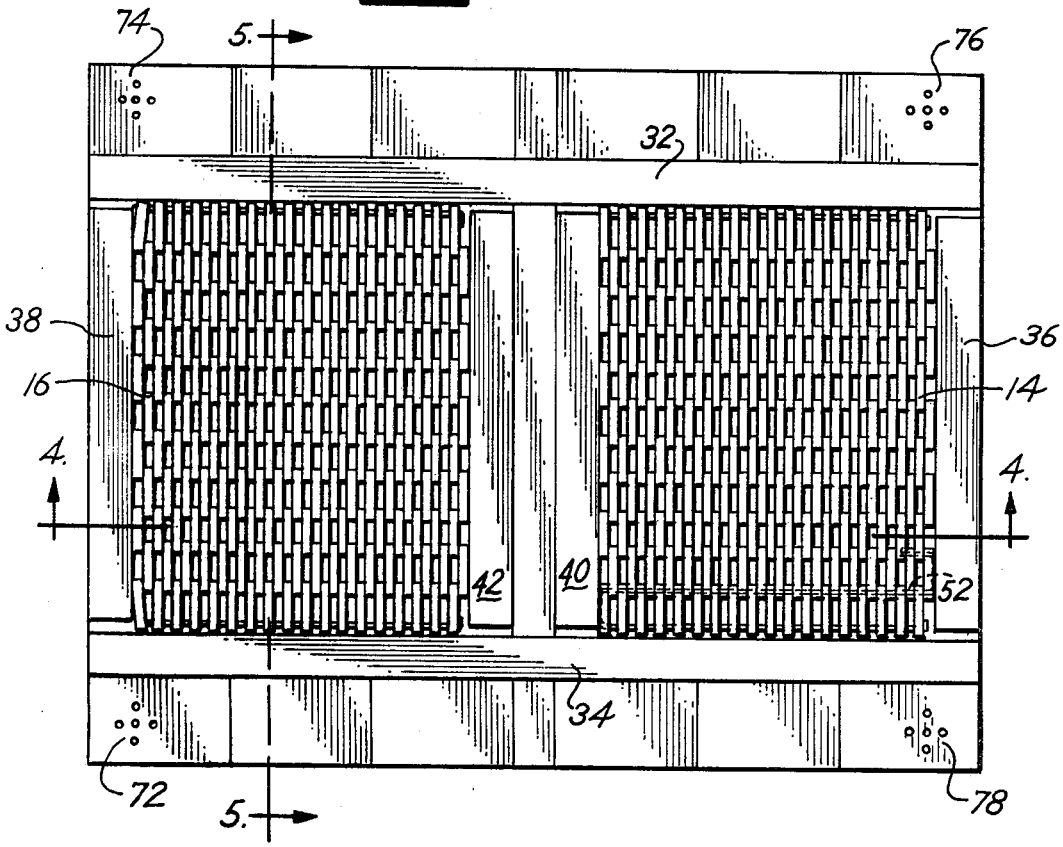
FIG. 3 is a top plan view of the golf practice station shown in the preceding figures.
Figure 4:
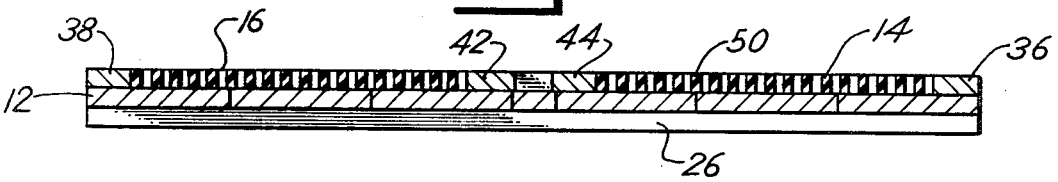
FIG. 4 is a vertical cross sectional view of the golf practice station shown in the preceding figures, the section being taken on line 4—4 of FIG. 3.
Figure 5:
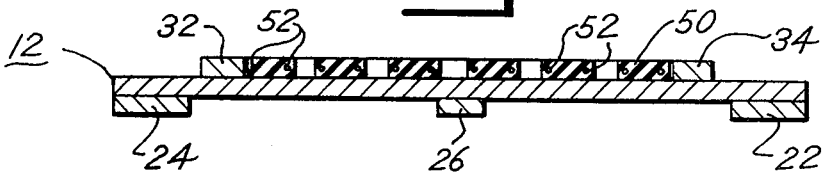
FIG. 5 is a vertical cross sectional view of the practice station shown in the preceding figures, the section being taken on line 5—5 of FIG. 3.

Referring more specifically to the drawings, and to FIGS. 1 and 2 in particular, numeral 10 indicates generally the present golf practice station, showing it in the position in which it is used to practice drives. The station may be used in conjunction with a golf ball net or on a driving range, and is placed solidly on the ground or other suitable supporting surface, and can easily be moved from place to place and stored and transported in a one man operation.

The practice station consists of a platform 12 having mats 14 and 16. The two mats are the same size, and one is used for supporting the golfer and the other is used for supporting a tee 18 for the balls being used in practice. In the embodiment of the invention illustrated in the drawings, the platform consists of a plurality of boards or planks 20 supported by side runners 22 and 24 and a center runner 26, the planks being secured to the runners by nails, screws or any other suitable securing means to form a solid structure with a flat, relatively smooth upper surface indicated generally by the numeral 30.

The mats 14 and 16 are held in place by side railings 32 and 34 and end railings 36 and 38. While the station may be of various sizes and the mat may be varied relative thereto, in the embodiment illustrated the mats are of a size such that they are spaced from one another and intermediate railings 40 and 42 are used to restrain the movement of the mats within the areas defined by the rails. The mats are constructed of relatively short sections 50 of fabric reinforced rubber material, and the ends of the various sections are joined together by wires or rods 52 extending through the rows of the overlapping ends of the sections to form a unitary but flexible mat structure. This type of mat structure is well known and used for a variety of different purposes, including door mats. The advantage, however, of the structure of the present mat is that it can easily be removed from the areas defined by the railings for the respective mats, and can be cleaned by shaking or washing. The areas for the mats can also be cleaned by inverting the station and washing off the surfaces. The mats are then merely laid in place in the respective areas. The railings are secured to the platform by nails, screws or any other suitable securing means, and the opposite ends of railings 36, 38, 40 and 42 are preferably spaced from railings 32 and 34 in order to permit water to drain from the mat areas and to facilitate cleaning of the areas.

In order to simulate conditions encountered by the golfer on the golf course, the station can be tilted to various angles, either upwardly, downwardly, forwardly or rearwardly, so that the golfer can practice shots on off-level surfaces such as are often encountered on fairways. The adjustment means shown in the drawings for tilting the station consists of a pair of blocks 60 and 62 secured in place by pins, bolts or screws 64 and 66 in block 60, and 68 and 70 in block 62 seating in respective holes in the hole arrangements 72, 74, 76 or 78 in the four corners of the platform. These blocks are tapered from side 80 to side 82 on the two blocks so that the blocks will seat firmly on the ground and firmly against the underside of the platform, when the platform is placed on the ground. With the block at one end as seen in FIGS. 6 and 7, the platform tilts in a slightly downward position from the golfer to the ball to be driven. The blocks can be placed on the two side hole arrangements 72 and 76 or 74 and 78, in order to tilt the station laterally either rearwardly or forwardly, depending on whether the blocks are beneath runner 22 or 24. A center hole 92 is preferably provided in the hole arrangements so that the blocks can be secured by a single bolt and easily rotated without having to remove them from the runners. The bolt extends upwardly through hole 90 in the blocks into and through hole 92 in the respective hole arrangement.

In the operation and use of the present golf practice station, if used in a level position, the blocks 60 and 62 are removed from the bottom of the platform and a tee is placed on mat 16, the stem of the tee extending through one of the spaces in the mat and projecting thereabove for supporting the ball to be driven. The tee may have a flat disc on the underside on which a portion of the mat will rest to hold the tee firmly in place. The golfer then places a ball on the tee and takes a driving position on the mat 14. When he drives, the rubber mat 14 forms a footing similar to that encountered on the tee of a standard golf course, and mat 16 provides a resilient surface to cushion the blow in the event the head of the club strikes the surface of the mat. Hence neither the club nor the mat will be damaged. If the practice station is used around the home, the ball is normally driven into a net. After the golfer has made a number of practice drives, the station may be adjusted by attaching blocks 60 and 62 to either end of the platform to provide an upward or downward slope relative to the golfer, or they may be attached to the runner on one side or the other to tilt the platform laterally to simulate an uphill or downhill condition of the fairway. While the station may be left in place for extended periods of time, the golfer will normally remove the station for temporary storage and return the station to the driving area when the practice is to be resumed.

It is seen from the foregoing description that the present golf practice station permits the golfer not only to practice in adverse weather and ground conditions, but also to practice on various simulated terrain conditions by shifting blocks 60 and 62 to the ends or the sides beneath the platform. The platform may be varied in size if desired, so long as the mat where the golfer stands and the mat holding the ball are located in proper position relative to one another for a particular golfer. While the platform is shown constructed of wood, it may be of other materials so long as it is of sufficient strength to support the golfer firmly while he is practicing the drives Further, the platform is shown constructed of a plurality of parallel planks; however, it may be a single plywood sheet, preferably reinforced by the runners.

While only one embodiment of the present golf practice station has been described in detail herein, various changes and modifications may be made without departing from the scope of the invention.

I claim:

1. A portable golf practice station comprising a substantially flat rectangular platform having an area for supporting a golfer and an area for a golf ball, walls on said platform forming two recessed areas spaced inwardly from the edges of the platform, a resilient, perforated mat means disposed in one of said recesses and forming a surface on which the golfer stands, a second resilient perforated mat means disposed in the other of said recesses and forming a surface in the area for a golf ball, two removable, platform support members, and means for securing said members to any two adjacent corners of said rectangular platform for tilting said platform from end-to-end from either end and from side-to-side from either side to simulate actual fairway conditions.

2. A portable golf practice station as defined in claim 1 in which said walls consist of rails secured to the upper surface of said platform.

3. A portable golf practice station as defined in claim 1 in which said mats are constructed of sections of resilient rubberized fabric secured together to form a flexible structure and having spaces between said sections through which water and dirt may pass into said recesses and on which a tee is held in position for supporting a golf ball for practice drives.

4. A portable golf practice station as defined in claim 3 in which said support members for tilting said platform from end-to-end and from side-to-side include removable tapered blocks secured to the underside of two adjacent corners of the platform.

5. A portable golf practice station as defined in claim 1 in which said support members for tilting said platform from end-to-end and from side-to-side include removable tapered blocks secured to the underside of two adjacent corners of the platform.

* * * * *